US005650124A

United States Patent [19]

Gilson

[11] Patent Number: 5,650,124

[45] Date of Patent: Jul. 22, 1997

[54] ADJUSTABLE PIPETTE

[76] Inventor: Warren E. Gilson, 601 N. Segoe Rd., Unit 104, Madison, Wis. 53705

[21] Appl. No.: 506,214

[22] Filed: Jul. 24, 1995

[51] Int. Cl.[6] ..... B01L 3/02

[52] U.S. Cl. ..... 422/100; 73/864.13; 73/864.14; 73/864.18

[58] Field of Search ..... 422/100, 101; 436/180; 73/425.6, 425.4 P, 864.14, 864.18; 128/234, 218 F; 222/43, 309

[56] References Cited

U.S. PATENT DOCUMENTS

| | | | |
|---|---|---|---|
| Re. 32,210 | 7/1986 | d'Autry | 73/864.14 |
| 3,827,305 | 8/1974 | Gilson et al. | 73/425.6 |
| 4,141,250 | 2/1979 | D'Autry | 73/425.6 |
| 4,284,604 | 8/1981 | Tervamaki | 422/100 |
| 4,298,575 | 11/1981 | Berglund | 73/864.13 |
| 4,909,991 | 3/1990 | Oshikubo | 422/100 |
| 5,012,682 | 5/1991 | Sabloewski | 73/864.18 |
| 5,018,394 | 5/1991 | Gilson | 73/864.18 |
| 5,104,624 | 4/1992 | Labriola | 422/100 |
| 5,320,810 | 6/1994 | Al-Mahareeq et al. | 422/100 |

*Primary Examiner*—Jill Warden
*Assistant Examiner*—Harold Y. Pyon
*Attorney, Agent, or Firm*—Mason, Kolehmainen, Rathburn & Wyss

[57] ABSTRACT

An adjustable pipette has a piston axially moveable in a body for alternately drawing and dispensing a liquid sample. An upper stop is moved axially to vary the sample size by rotation of a threaded shaft. A drive member is keyed to the threaded shaft for simultaneous rotation but the drive member and shaft can freely move axially relative to one another. The drive member is moved axially to an unlocked position in order to adjust the sample volume and is axially moved to a locked position in which rotation and inadvertent misadjustment of the sample volume is prevented. A collar on the drive member fits tightly into a throat of the pipette body to lock the drive member against rotation.

4 Claims, 3 Drawing Sheets

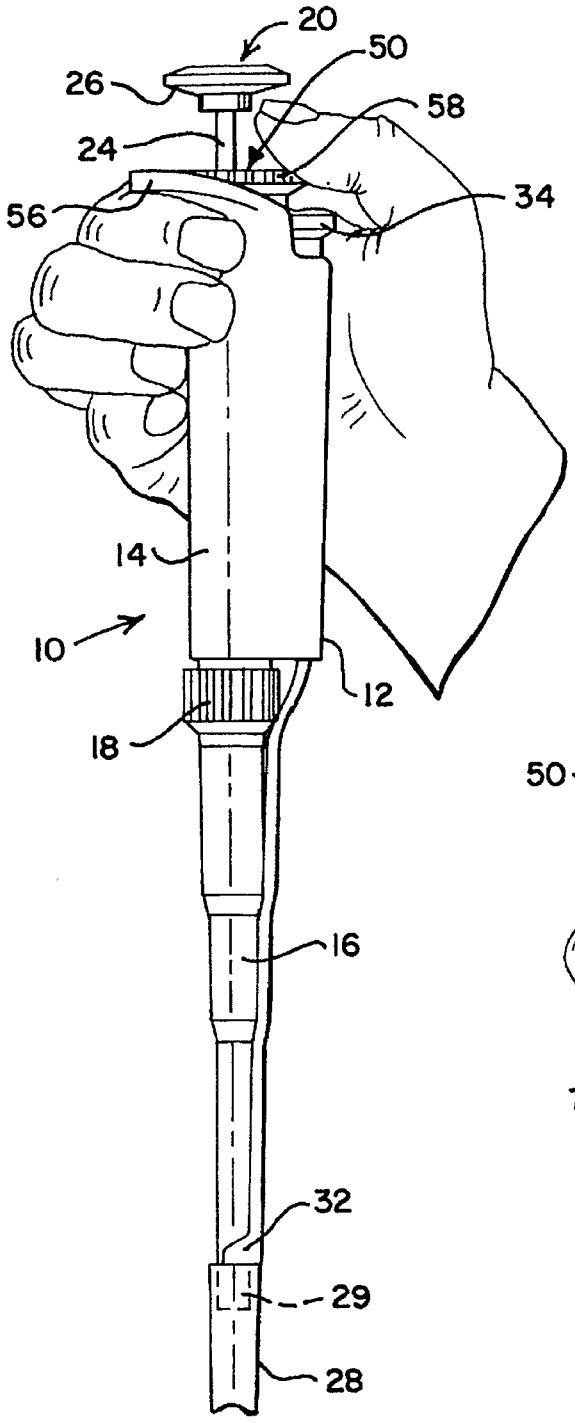
FIG. 1
FIG. 2
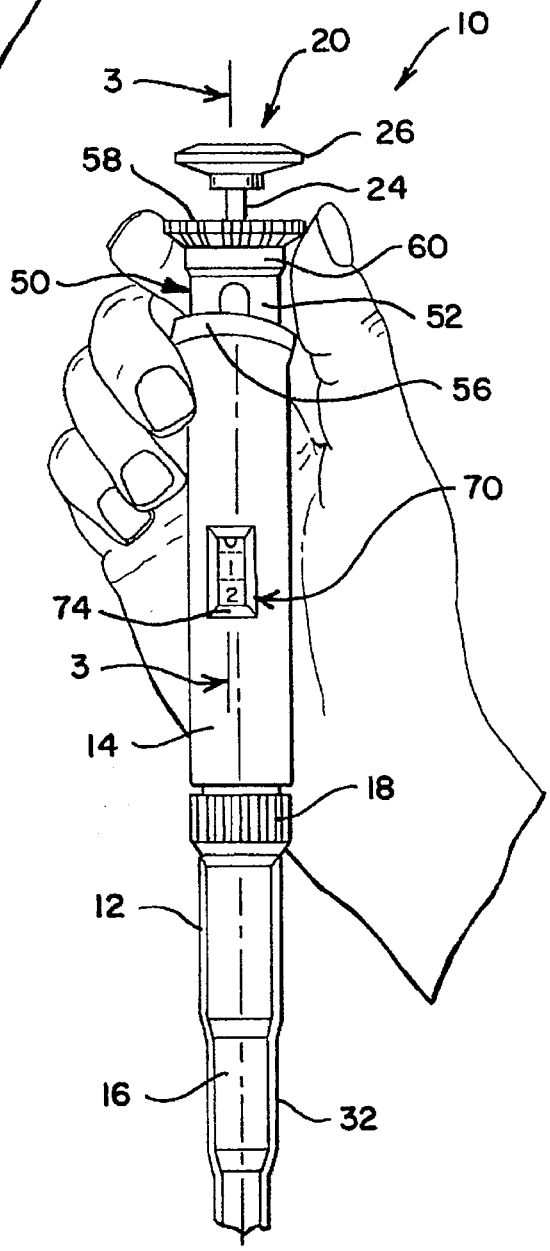

ADJUSTABLE PIPETTE

FIELD OF THE INVENTION

The present invention relates to adjustable pipettes, and more particularly to improvements in pipette volume adjustment mechanisms making it easy to adjust the pipette sample size and to lock the adjustment mechanism.

DESCRIPTION OF THE PRIOR ART

A pipette for transferring liquid samples typically includes a body with a piston or plunger movable in an upward stroke to draw a liquid sample into a sample receiving region, for example in a disposable tip, and movable in a downward stroke to discharge the sample. U.S. Pat. No. 3,827,305 discloses an adjustable pipette wherein an upper stop is movable to vary the piston stroke length and, as a result, the size of the liquid sample. The adjustment is made by rotating a threaded shaft by manipulating a knurled cap on the shaft externally of the pipette body. An indicator provides a readout of the selected sample volume. In order to prevent inadvertent misadjustment of the selected sample size, a locking ring on the threaded shaft can be threaded against the body of the pipette. It can be inconvenient to lock the shaft in place using the rotating locking ring.

U.S. Pat. No. 4,141,250 discloses a diluting device also having a threaded shaft for adjusting sample size by movement of an upper stop. In this arrangement, which has been used in adjustable pipettes as well as in the disclosed diluting device, the adjustment is made by rotating a nut carried by the shaft and accessible through openings or windows in the side wall of the device. Inadvertent misadjustment is prevented by a friction ring compressed between the nut and the body. The friction ring provides a continuous frictional effect that must be overcome when the nut is rotated to make a volume adjustment.

U.S. Pat. No. 5,018,394 discloses a pipette or diluting device in which volume adjustments are made by rotating a nut or actuator located inside the pipette body. A friction ring is used to hold the actuator in position and provides a friction effect that must be overcome to make a volume adjustment. A retractable rotary drive knob accessible outside of the pipette body may be used to rotate the actuator so that it is not necessary to grasp the actuator through windows or openings in the body.

SUMMARY OF THE INVENTION

A principal object of the present invention is to provide an adjustable pipette wherein the sample size adjustment can be made easily without the necessity for overcoming a large, fixed frictional locking force and wherein inadvertent changes in the selected sample volume are prevented with a convenient, separate and easily engaged locking arrangement. Another object of the invention is to provide improvements in pipettes that overcome disadvantages of known devices.

In brief, in accordance with the invention there is provided an adjustable pipette including a body and piston means movable in the body in an axial direction to draw and dispense a liquid sample. An adjustment member is supported by the body for movement in the axial direction. A stop is supported by the adjustment member and engages the piston means to limit the movement of the piston means and adjust the volume of the liquid sample. An actuator supported on the body moves in the axial direction between a locked position wherein the actuator is interlocked with the body and a released position wherein the actuator can be moved relative to the body. The actuator and the adjustment member are interconnected for moving the adjustment member to a selected position in response to movement of the actuator relative to the body.

BRIEF DESCRIPTION OF THE DRAWINGS

The present invention together with the above and other objects and advantages may best be understood from the following detailed description of the preferred embodiment of the invention illustrated in the drawings, wherein:

FIG. 1 is a side elevational view of a pipette constructed in accordance with the present invention and showing components of the pipette in the locked condition;

FIG. 2 is a front view of the pipette of FIG. 1 showing components of the pipette in the unlocked position in which the sample volume may be adjusted;

DETAILED DESCRIPTION OF THE PREFERRED EMBODIMENTS

Figure 3:
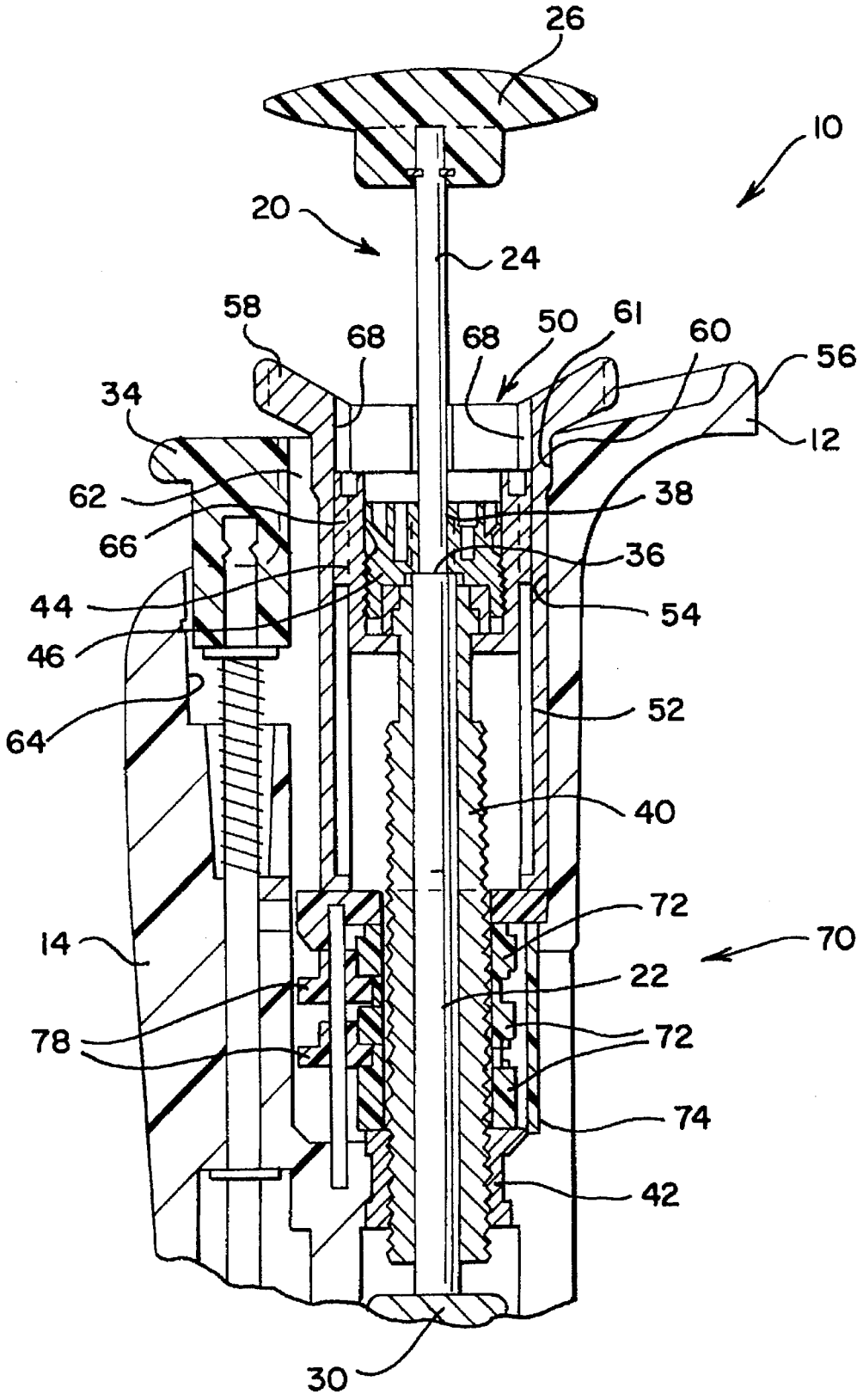
FIG. 3 is an enlarged, fragmentary sectional view of the pipette taken along the line 3—3 of FIG. 2.

Having reference now to the drawings, there is illustrated a pipette generally designated as 10 and constructed in accordance with the principles of the present invention. A body 12 includes an upper handle portion 14 adapted to be held in the hand of a user as seen in FIGS. 1 and 2. The body 12 also includes a lower base portion 16 attached to the handle portion by a coupling nut 18.

A piston includes an upper piston assembly 20 having a spindle 22 with a shank 24 extending upwardly from the body 12 and provided with a push button 26. Button 26 is pressed downward by the thumb of the user and returned upward by spring force to move the piston assembly in the axial direction. The piston assembly includes a lower piston structure 30 partly seen in FIG. 3 for changing the volume of a pressure region in the lower base portion 16. A disposable tip 28 is frictionally mounted at the lower end or tip 29 of the base portion 16. The tip 28 may be placed in a liquid, and a liquid sample is drawn into the tip when the button 26 is released after being depressed. Then the button 26 may again be depressed to dispense the liquid sample from the tip 28. The structure for performing this pipetting operation may be as described in U.S. Pat. No. 3,827,305, incorporated herein by reference.

The tip 28 may be removed from the base portion 16 by an ejector 32 when a tip ejector button 34 is depressed by the thumb of a user. A further description of the structure and operation of the tip ejector mechanism may be found in U.S. Pat. No. Re. 32,210, incorporated herein by reference.

Upward movement of the spindle 22 is limited by engagement of a stop surface 36 on the spindle at the upper portion of the shaft 40 with a stop collar 38. The uppermost position is illustrated in FIG. 3. The volume of the liquid sample that is drawn into and dispensed from the pipette 10 is adjusted by moving the stop 38 axially with respect to the body 12 to vary the axial stroke of the upper piston assembly 20.

An externally threaded hollow shaft 40 is threaded into a nut 42 fixed to the body 12 so that rotation of the shaft 40 is translated to axial movement of the shaft 40. The spindle 22 is received in the axial opening in the shaft 40 for free sliding movement. The upper end of the shaft 40 is attached to a drive cup 44 that receives a calibration member 46. Stop 38 is part of the calibration member 46, and member 46 is threaded into the cup 44 so that the axial position of stop 38 can be varied relative to the shaft 40 in order to calibrate the pipette.

Figure 4:
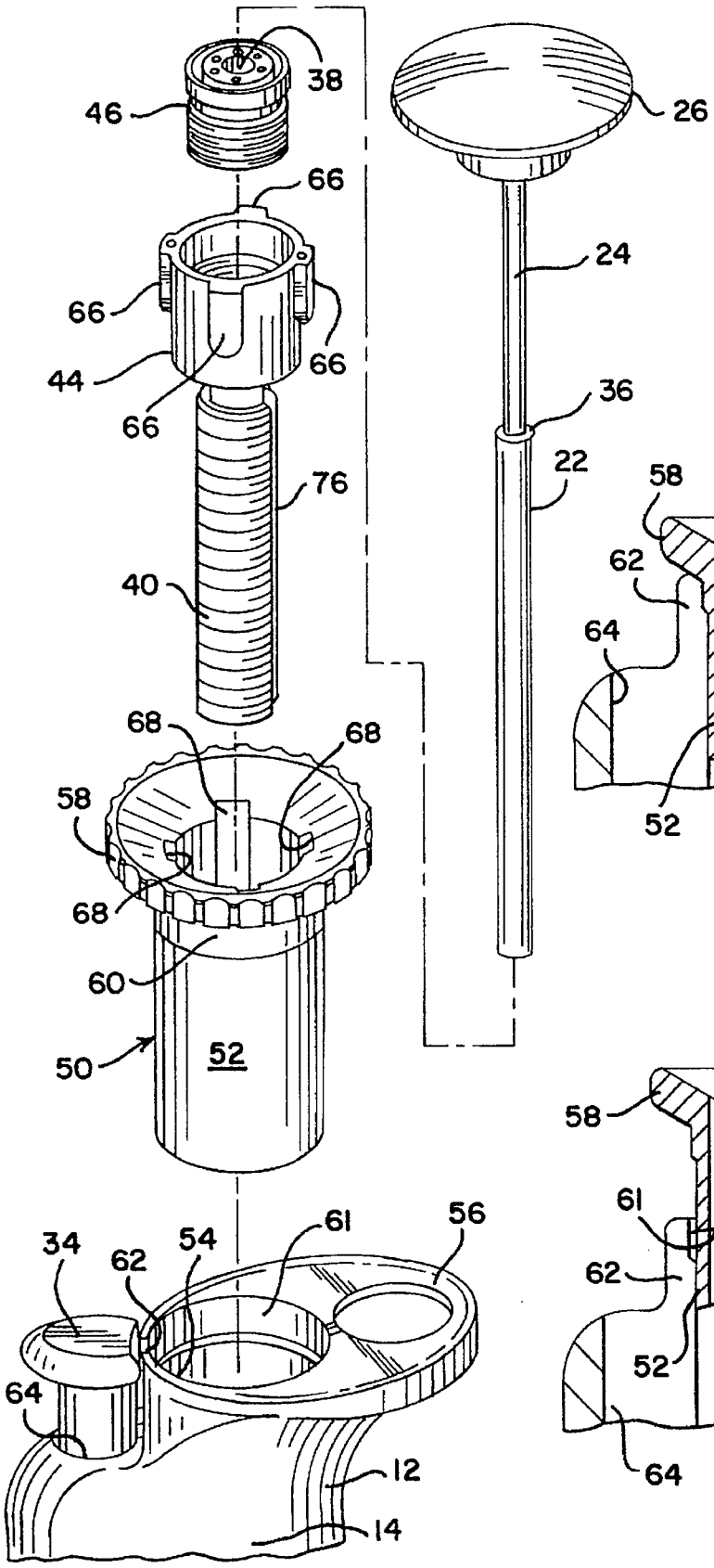
FIG. 4 is an exploded isometric view on an enlarged scale of components of the pipette.

In accordance with the invention, a drive member 50 performs the dual functions of adjusting the sample volume and of locking the adjustment mechanism to prevent inadvertent volume size misadjustment. Drive member 50 includes a collar portion 52 that extends into the body 12 through a throat opening 54 in the upper end of the handle portion 14 between the ejector button 34 and a handle end flange 56. Sufficient clearance is provided so that the collar 52 moves freely in the throat 54. A knob portion 58 of the drive member 50 permits the drive member to be manipulated by the user. The drive member 50 can move axially between a retracted position as seen in FIGS. 1, 3 and 5 and an extended position as seen in FIGS. 2 and 4.

Figure 5:
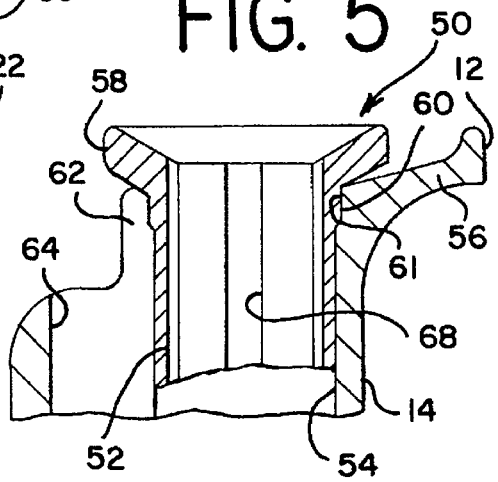
FIG. 5 is an enlarged fragmentary sectional view like the upper part of FIG. 3 illustrating components of the pipette in the locked condition.
Figure 6:
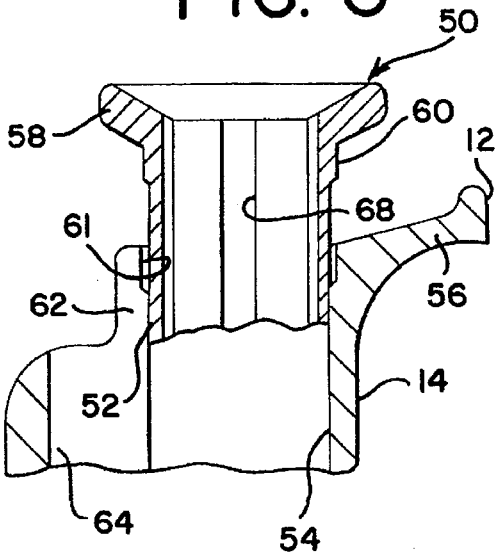
FIG. 6 is a view like FIG. 5 illustrating the components in the unlocked position in which the sample volume may be adjusted.

The drive member 50 is locked in place in the retracted position of FIGS. 1, 3 and 5 by a lock surface 60 having a diameter larger than the diameter of the collar 52. The surface 60 fits tightly in an enlarged end portion 61 of the throat 54. For example the surface 60 may have an interference fit in the enlarged end portion 61 of the throat 54, and the surface 60 may have a slightly tapered shape. The tight fit may be augmented by permitting some flexibility of the wall of the throat 54 due to an optional slot 62 extending from the throat 54 to a passage 64 receiving the ejector button 34. Alternatively, a slot may be provided in the wall of the drive member 50, or no slot may be used. The tight fit frictionally locks the drive member 50 against rotation when it is in the retracted position. The drive member 50 may be unlocked by moving the drive member axially. The lock is sturdy and reliable, and is not damaged if the user forces the drive member 50 to rotate even though it is locked.

Drive member 50 is connected to the drive cup 44 so that they are constrained to rotate together but can freely move axially relative to one another. Cup 44 includes axially oriented keys 66 slidably received in keyway slots 68 formed on the interior wall of the collar portion 52. The freedom of axial motion permits the drive member 50 to be moved between its retracted and extended positions and permits the shaft 40 to be moved to axially adjusted positions in response to rotation in the nut 42. The rotational coupling permits the drive member 50 to rotate the drive cup 44 and the shaft 40 to adjust the sample size.

A visual indication of the selected sample size is provided by an indicator 70 having units, tens and hundreds wheels 72 visible through a window 74. An axial slot 76 in shaft 40 permits the shaft to be keyed to the units wheel, and the other wheels are driven by gears 78. A further description of this type of sample volume indicator is found in U.S. Pat. No. 3,827,305, incorporated herein by reference.

The pipette 10 may be operated with one hand. To select a desired liquid sample volume, the user may grip the handle 14 and extend the knob 58 with a thumb and finger as indicated in FIG. 2. When the drive member 50 is in this unlocked position, the entire adjustment mechanism is largely free of friction, and the knob 58 is easily rotated to rotate cup 44 and shaft 40. Rotation of the shaft 40 in nut 42 results in axial movement of the stop 38. The indicator 70 displays the selected sample volume.

When the pipette is adjusted to the desired sample volume, the user may press the knob 58 down to the retracted position of the drive member 50 with a thumb as seen in FIG. 1. This axial movement does not alter the selected sample volume. The lock surface 60 tightly engages the enlarged end portion 61 of throat 54 to lock the drive member against inadvertent rotation. Because the drive member 50 is rotationally keyed to the cup 44 and thus to the shaft 40 and stop 38, locking of the drive member against rotation serves to lock the entire volume adjustment mechanism.

While the present invention has been described with reference to the details of the embodiments of the invention shown in the drawing, these details are not intended to limit the scope of the invention as claimed in the appended claims.

What is claimed is:

1. An adjustable pipette comprising:

an elongated hollow body adapted to be grasped in the hand of a user;

said body having a lower end with a tip and having an upper end;

a piston assembly movable axially in said body to draw up and dispense a liquid sample and including a piston and a spindle extending from said upper end;

an adjustment shaft threadedly received in said body and an adjustable piston stop carried by said shaft in the path of said piston assembly;

a drive member including a knob disposed beyond said upper end of said body and a collar received in said upper end of said body;

said collar being keyed to said shaft for simultaneous rotation so that rotation of said drive knob rotates said shaft and moves said stop axially to a selected volume adjustment position;

said collar being slidably mounted with respect to both said body and said shaft for movement in said axial direction between a locked position and a free position; and said drive member and body including interconnecting lock structures for holding said drive member fixed relative to said housing in said locked position.

2. An adjustable pipette as claimed in claim 1, said lock structures including a throat defined in said upper end of said body and a lock surface on said drive member tightly received in said throat in said locked position.

3. An adjustable pipette as claimed in claim 1 said lock structures including a generally circular throat defined in said body, and a generally circular lock surface on said collar tightly received in said throat in said locked position.

4. An adjustable pipette as claimed in claim 3, said throat having a slot permitting resilient expansion of the throat to receive said lock surface.

* * * * *